US008366388B2

(12) United States Patent
Bruhn et al.

(10) Patent No.: US 8,366,388 B2
(45) Date of Patent: Feb. 5, 2013

(54) MULTI-STAGE CENTRIFUGAL PUMP (AXIAL FACE SEAL)

(75) Inventors: Aage Bruhn, Bjerringbro (DK); Lars Ostergaard, Randers (DK)

(73) Assignee: Grundfos Management a/s, Bjerringbro (DK)

( * ) Notice: Subject to any disclaimer, the term of this patent is extended or adjusted under 35 U.S.C. 154(b) by 502 days.

(21) Appl. No.: 12/720,735

(22) Filed: Mar. 10, 2010

(65) Prior Publication Data

US 2010/0232949 A1 Sep. 16, 2010

(30) Foreign Application Priority Data

Mar. 10, 2009 (EP) ..... 09003471

(51) Int. Cl.
*F04D 29/12* (2006.01)

(52) U.S. Cl. ..... 415/231; 415/216.1

(58) Field of Classification Search ..... 277/358, 277/370, 371; 415/109, 174.2, 174.3, 231, 415/216.1; 416/174
See application file for complete search history.

(56) References Cited

U.S. PATENT DOCUMENTS

| | | | | |
|---|---|---|---|---|
| 2,929,328 | A | 3/1960 | Newcomb | |
| 6,568,686 | B2 * | 5/2003 | Hadley | 277/370 |
| 7,311,307 | B2 * | 12/2007 | Dahlheimer | 277/373 |

FOREIGN PATENT DOCUMENTS

| | | | |
|---|---|---|---|
| DE | 295 11 211 | U1 | 11/1995 |
| EP | 0 261 082 | A2 | 3/1988 |
| GB | 2 235 737 | A | 3/1991 |
| WO | 2006/008844 | A1 | 1/2006 |

OTHER PUBLICATIONS

Office Action issued Sep. 5, 2012 in CN Application No. 201010135598.7.

* cited by examiner

*Primary Examiner* — Ninh H Nguyen
*Assistant Examiner* — Liam McDowell
(74) *Attorney, Agent, or Firm* — Panitch Schwarze Belisario & Nadel LLP

(57) ABSTRACT

An axial face seal (13), which seals a pump housing in the region of the pump shaft (12), is constructed in an axially compact manner. Spring holders (24, 25), which transmit the required pressing force of a compression spring (23), are connected to one another with a positive fit in a rotation direction, and hold a rotating axial face seal ring (19) in a rotationally fixed manner to the pump shaft (12). The spring holders (24, 25) are compact and enclose an abutment ring (33) for pump impellers as well as the compression spring (23). A motor-side spring (24) engages over the rotating axial face seal ring (19), by which an axially extremely short constructional length is achieved.

14 Claims, 2 Drawing Sheets

12
13
14
15
16
17
18
19
20
21
22
23
24
25
26
27
28
29
30
31
32
33
34
35
36

MULTI-STAGE CENTRIFUGAL PUMP (AXIAL FACE SEAL)

BACKGROUND OF THE INVENTION

The present invention relates to a multi-stage centrifugal pump.

Single-stage or multi-stage centrifugal pumps are considered as belonging to the state of the art. In one aspect, the present invention relates to a multi-stage centrifugal pump whose drive shaft is arranged in a lying manner, i.e. arranged horizontally with normal operation. Such centrifugal pumps, as are considered as belonging to the state of the art, are, for example, offered by the company Grundfos in the series CH and CHN. These pumps have a pump housing with a shaft which is rotatably mounted therein and which, at its motor-side end, comprises at least one cylindrical section and connecting to this on the pump side, comprises a splined shaft section, on which impellers are arranged in a rotationally fixed manner. The impellers are clamped between an abutment ring seated on the shaft and the free shaft end. Such pumps are driven by an electric motor, whose drive shaft is connected in a rotationally fixed manner to the shaft mounted in the pump housing and carrying the impellers, and is connected to the pump via screw connections.

An axial face seal is provided, which is incorporated between the cylindrical shaft section and the pump housing, in order to permanently seal the stationary housing part of the pump with respect to the rotating shaft. This axial face seal comprises a stationary axial face seal ring which is sealed with respect to the pump housing, and a rotating axial face seal ring which is arranged on the shaft and is sealed with respect to the shaft. These rings comprise sliding axial sealing surfaces which are impinged to one another by a spring force. A spring, which is arranged between two spring holders and impinges the spring holders with a pressure force in opposite directions, is provided for mustering the spring force.

These known centrifugal pumps have proven their worth, in particular also the axial face seal described above. However, the arrangement described above necessitates a relatively large axial constructional length.

Against this background, it is one object of the present invention to design a centrifugal pump, such that its axial construction length may be reduced, with an otherwise equal hydraulic performance. Moreover, the design should be such that it may be manufactured as inexpensively as possible in large series manufacture. The present invention achieves these desirable features.

BRIEF SUMMARY OF THE INVENTION

The multi-stage centrifugal pump according to the present invention preferably comprises a pump housing and a shaft which is rotatably mounted therein and which at its motor-side end comprises at least one cylindrical section, and, connecting to this on the pump side, comprises a splined shaft section, on which impellers are arranged in a rotationally fixed manner. The impellers are clamped between an abutment ring seated on the shaft and the free shaft end. An axial face seal is incorporated between the cylindrical shaft section and the pump housing, and comprises a stationary axial face seal ring which is arranged in the pump housing and is sealed with respect to this, as well as a rotating axial face seal ring which is arranged on the shaft and is sealed with respect to this. These axial face seal rings slide on one another, with their axial surfaces which are directed to one another, and are impinged by spring force. Two spring holders, between which compression spring means are held, are preferably provided for mustering the spring forces.

According to one aspect of the present invention, the abutment ring is arranged in the transition region of the shaft between the cylindrical section and the splined shaft section, as well as between the spring holders. Moreover, positive-fit means are provided between the spring holders, which are effective at least in the normal operation rotation direction of the shaft, thus in the working rotation direction.

This solution according to the present invention utilizes the otherwise unused transition region of the shaft, thus the diameter difference between the groove base of the splined shaft section towards the cylindrical section, for the arrangement of the abutment ring. The abutment ring at the same time lies between the spring holders, thus in a space which otherwise is usually not used with regard to design. The axial constructional length of the pump may be considerably reduced by way of this. According to the present invention, positive-fit means are provided between the spring holders and transmit the rotational movement of the shaft from the splined shaft section onto the pump-side spring holder, and, via the positive-fit means, onto the motor-side spring holder and from there onto the rotating axial face seal ring, in order to let the axial face seal ring rotating together with the shaft co-rotate, without loading its sealing with respect to the shaft.

Advantageously, the abutment ring is held on the shaft with a positive fit at least in the axial direction towards the motor-side shaft end. Such a positive-fit holding is particularly simple to realize if the cylindrical shaft section has a larger diameter than at the groove base of the splined shaft section, which is envisaged according to a further formation of the present invention. Moreover, the cylindrical shaft section should have an equally large or larger diameter than the splined shaft section outside the grooves, in order to permit an assembly of the axial face seal rings from the pump side. Thereby, the abutment ring is usefully not only held on the shaft with a positive fit in the axial direction, but also in the rotational direction. For this, the abutment ring on its inner side has a suitable profiling, with which it is engaged with the splined shaft profile of the splined shaft section with a positive fit. With large series manufacture, the profiling of the shaft into the splined shaft profile is advantageously effected by way of force deformation, i.e., by way of a forming operation of the shaft by way of a die. Since this method entails comparatively low tolerances also in the axial direction, the abutment ring may be attached on the shaft at a defined location, and specifically by way of a positive fit, which is particularly advantageous.

In order to ensure an as large surfaced as possible bearing and thus also to be able to accommodate high forces with this, according to a further formation of the present invention, the abutment ring is provided with oblique surfaces on its inner side, which are supported on the at least one corresponding oblique surface of the shaft in the transition region of the shaft between the cylindrical section and the splined shaft section. These oblique surfaces may be achieved on the shaft side in a simple manner by way of the forming method described above. On the abutment ring side, these are usefully formed just as with the splined shaft profile, for example by way of forging. Alternatively, a cast component or a component machined in a material-removing manner may also be applied here.

The axial construction length of the centrifugal pump may be reduced further by way of arranging and designing the spring means such that they at least partly engage over the abutment ring as well as the rotating axial face seal ring. The axial length of the axial face seal is reduced by way of this, such that it corresponds roughly to the axial length of the rotating axial face seal ring plus the axial length of the abutment ring.

Simultaneously, the abutment ring may correspond roughly to the inner diameter of the spring, and by way of this, may accommodate the forces of the oblique surface of the transition region without deforming. This may be effected advantageously by way of the provision of a helical compression spring as spring means. Such helical compression springs ensure an adequate spring path with a suitable design, are inexpensive in manufacture and, with a suitable dimensioning, are sufficient in mustering the required forces.

The design according to the present invention is preferably such that the axial face seal is not assembled from the motor side, but from the pump side of the shaft. In order then to simplify the assembly and in particular to ensure that the abutment ring remains in its correct position, according to a further formation of the present invention, a positive fit means may be provided on the spring holders, with which these may be fixed axially to one another at least in one direction under the biasing of the spring means, for the purpose of assembly. Thus the spring means during the assembly are biased by way of these positive fit means of the spring holders, and the spring means are practically deactivated with regard to their action. Only when the assembly is completed and the last pump impeller is applied onto the shaft and clamped, are these positive fit means released, in order to muster the necessary axial pressure on the axial face seal, in particular on the rotating axial face seal ring. For this, according to the present invention, one may provide a type of bayonet connection between the spring holders. It is particularly advantageous if the bayonet connection is designed such that the locking is effected opposite to the working direction or that the locking is automatically lifted on moving the shaft in the working rotation direction. Such an arrangement has the advantage that no separate working step is necessary for releasing the positive-fit means between the spring holders, but that these are released automatically on starting up the centrifugal pump in the working rotation direction.

According to an advantageous further formation of the present invention, in order to be able to arrange the spring means, in particular the helical compression spring, such that it surrounds the rotating axial face seal ring, the spring holder on the axial face seal ring side (axial face seal ring side holder) is designed in an angulated (cranked) manner, such that it peripherally engages over the rotating axial face seal ring with its angulated part, wherein the preferably helical compression spring is guided into this overlapping part.

At least one catch engaging into the splined shaft profile with a positive fit, is provided on the spring holder on the impeller side, in order to connect the impeller-side spring holder to the shaft in a rotationally fixed manner. Advantageously, the impeller-side spring holder comprises a central recess which is profiled according to the splined shaft profile, so that it is seated on the shaft with a positive fit over its whole periphery.

The stationary axial face seal ring comprises positive fit means which are preferably attached on its outer periphery, in order to secure this in the pump housing against rotation. On attachment of the positive-fit means on the outer periphery, these may be well assembled, without a concealed alignment being necessary, as is the case for example with the arrangement of positive-fit means on an axial side.

Advantageously, according to a further formation of the present invention, the impeller-side spring holder is designed in a pot-like manner and comprises recesses in the peripheral wall, which are open towards the spring holder on the axial face seal ring side and into which radial projections of the axial face seal ring side spring holder engage. The radial projections of the axial face seal ring side spring holder get into the region of the impeller-side spring holder via these open recesses, and the latter spring holder then catches these with a positive fit in the rotation direction.

In order to prevent a wear of the bearing surface occurring in the recess, in particular when the previously mentioned parts are formed of sheet metal, according to a further formation of the present invention, the edges of the recesses are designed reinforced in the engagement region of the projections. Such a reinforcement may be particularly simply effected by way of increasing the bearing surface, which, with a sheet metal component, may be effected for example by way of a section being bent up, so that it is not the sheet metal edge, but the flat side which forms the bearing surface. In this manner a "digging" of a projection into the bearing surface is effectively prevented.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

The invention is hereinafter explained in more detail by way of one embodiment example represented in the drawing. There are shown in the drawings.

DETAILED DESCRIPTION OF THE INVENTION

Certain terminology is used in the following description for convenience only and is not limiting. The words "inner" and "outer" refer to directions toward and away from, respectively, the geometric center of the pump, and designated parts thereof, in accordance with the present invention. Unless specifically set forth herein, the terms "a," "an" and "the" are not limited to one element, but instead should be read as meaning "at least one." The terminology includes the above-listed words, derivatives thereof and words of similar import.

Figure 1:
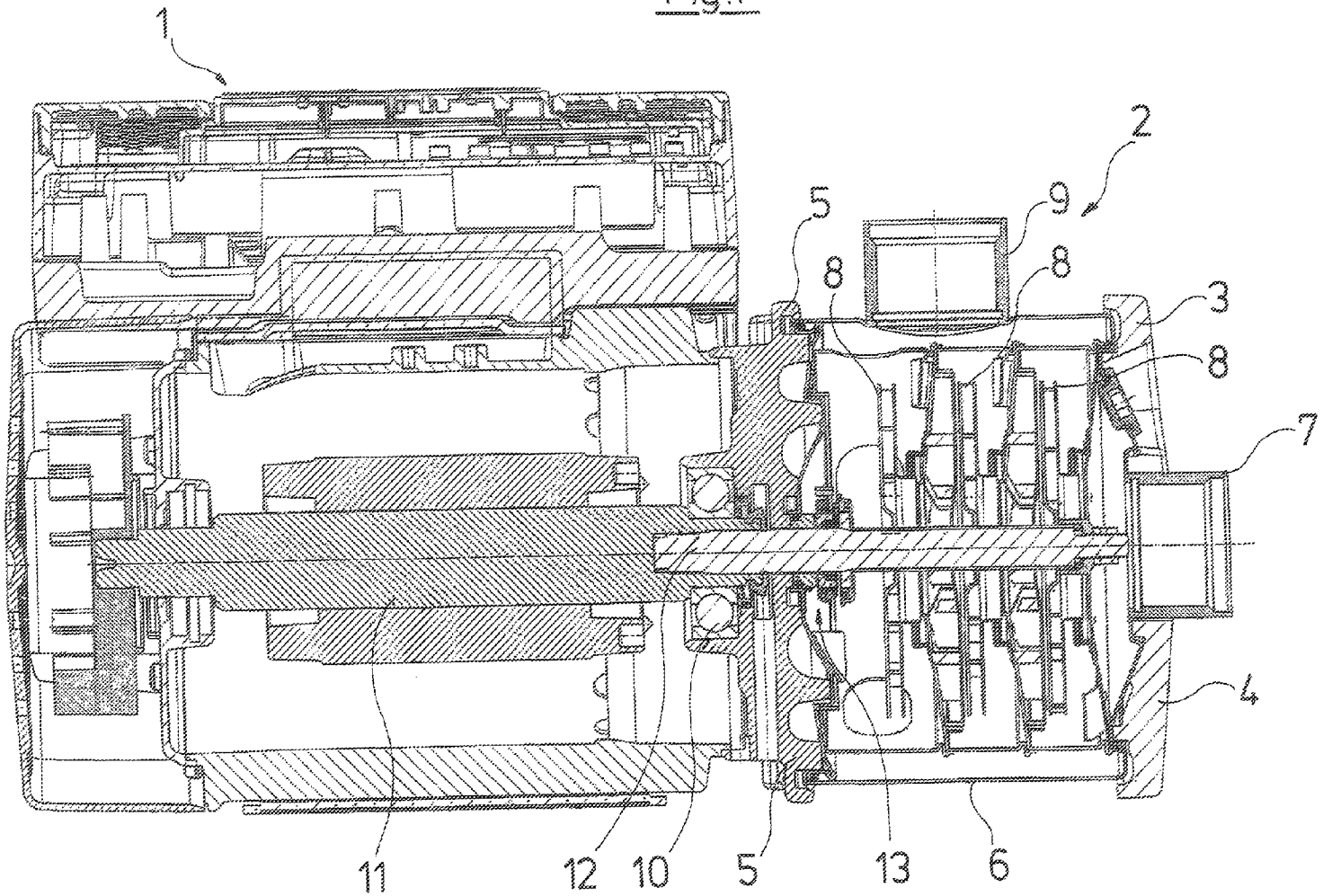
FIG. 1 is a cross-sectional elevation view of a three-stage centrifugal pump with a drive motor in a longitudinal section in accordance with a preferred embodiment of the present invention.
Figures 2, 3:
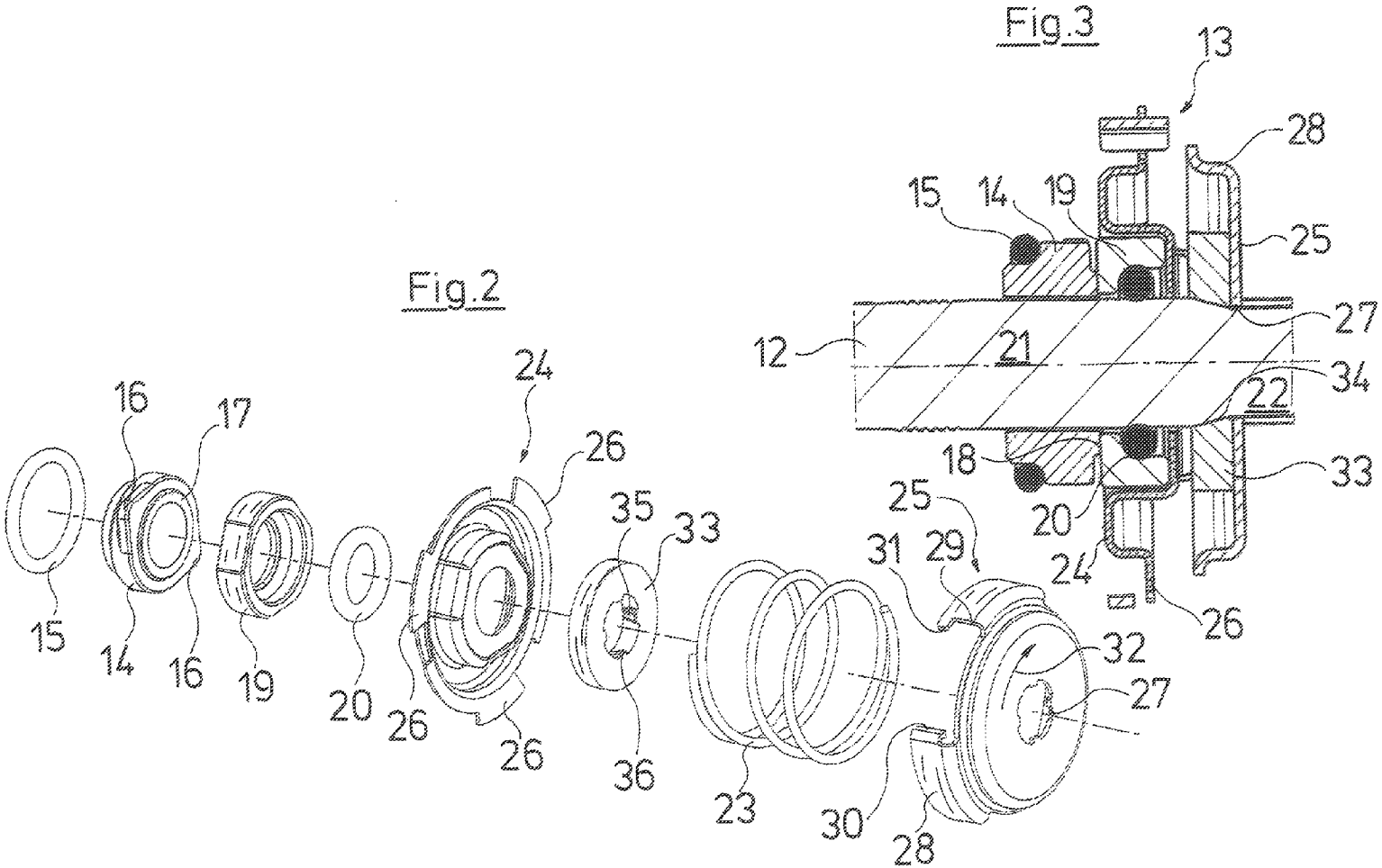
FIG. 2 is an exploded perspective view of an axial face seal with spring holders, springs and holding ring in accordance with a preferred embodiment of the present invention.
FIG. 3 is an enlarged cross-sectional elevation view of the axial face seal ring and its attachment shown in FIG. 1.

Referring to the drawings in detail, wherein like numerals indicate like elements throughout the several views, FIGS. 1-3 show a centrifugal pump assembly, generally designated 2, in accordance with a preferred embodiment of the present invention. The centrifugal pump assembly 2, which is represented by way of FIG. 1 in a longitudinal section, preferably includes an electric drive motor 1, on which the preferably three-stage centrifugal pump 2 is attached, which drives the motor 1. The centrifugal pump 2 preferably includes a pump housing 3 that is lined or formed with stainless steel sheet metal. End-side housing parts 4, 5, or otherwise referred to herein as an outer support flange 4 and an inner connection flange 5, respectively, are preferably designed as cast parts, whereas a housing casing 6 is preferably designed of sheet metal. The delivery fluid entry is effected through a suction union 7, which is preferably provided in the support flange 4. From there, the fluid to be delivered, via three pump stages with impellers 8, gets into an annular space formed between the pump stages and the casing 6, and from there to a radially departing pressure union 9 on the casing 6.

Preferably, the connection flange 5 in this embodiment also forms the end-side closure of the motor 1 and carries a bearing 10, with which a motor shaft 11 is mounted in this region. The motor shaft 11 is preferably firmly connected to a pump shaft 12, on which the impellers 8 are seated and which is sealed with respect to the connection flange 5 by way of an axial face seal 13, and the pump shaft 12 passes through the flange connection flange 5.

As seen in FIGS. 2 and 3, the axial face seal 13 preferably includes a stationary axial face seal ring 14. The stationary axial face seal ring 14 is preferably fixed with the pump housing 3 and thus does not co-rotate and is sealed with respect to the pump housing 3, in particular the sheet metal lining in the region of the pump housing 3, by way of an O-ring 15. The stationary axial face seal ring 14 preferably comprises two lugs 16 which project beyond the otherwise circular shape and which are arranged diametrically and bear on a sheet metal section of the lining (not shown). The lining preferably holds the stationary axial face seal ring 14 in a rotationally fixed manner and furthermore ensures that gas entrained by the delivery fluid does not accumulate in the region of the stationary axial face seal ring 14, but is led away with the delivery fluid. An axial surface 17 preferably faces the pump and is in the form of an annular surface which forms the stationary sliding surface of the seal. The axial surface 17 is preferably axially set back with respect to the pump.

As seen in FIG. 3, an axial surface 18 of a rotating axial face seal ring 19 preferably slides on this sliding surface 17, and the rotating axial face seal ring 19 is sealed by way of an O-ring 20 with respect to the pump shaft 12 on which it is seated and with which it co-rotates. Preferably, the pump shaft 12 is cylindrical in the region of the axial face seal rings 14, 19 and there forms a cylinder shaft section 21. The pump shaft 12 is preferably formed in a tapered manner towards the impellers 8, and there merges into a splined shaft profile of a splined shaft section 22. The impellers 8 of the pump are preferably seated on the splined shaft section 22 with a positive fit.

Referring to FIG. 3, a helical compression spring 23 is preferably provided, which is arranged between two spring holders 24, 25 in order to press the axial surfaces 17, 18 of the axial face seal rings 14, 19, respectively, onto one another with the required force on operation. A motor-side spring holder 24 of the spring holders 24, 25 is preferably designed in an angulated manner. More specifically, the motor-side spring holder 24 is preferably designed for the positive-fit accommodation of the rotating axial face seal ring 19, in the rotational direction of the pump shaft 12, and surrounds this ring peripherally in an almost complete manner, as is evident from FIG. 3. The motor-side spring holder 24 preferably connects to the cylinder section 21 of the pump shaft 12 with little play. More specifically, the motor-side spring holder 24 preferably firstly extends radially and then bends away by about 90° towards the motor 1 under the positive-fit entrapment of the rotating axial face seal ring 19 in the rotational direction of the pump shaft 12, as well as of the O-ring 20. The motor-side spring holder 24 preferably then runs parallel to the pump shaft 12 up to close to the motor-side axial end of the axial face seal ring 19, and from there, bent away by 90°, continues radially outwardly. The motor-side spring holder 24 is then preferably bent by 90° to the impeller 8 at the end of the radial section, in order finally to merge into a further radial section, in which radial projections 26 are formed.

In contrast, a pump-side or impeller-side spring holder 25 of the spring holders 24, 25, on its inner side, preferably includes a profiling for the engagement into the splined shaft profile in the region of the splined shaft section 22. A central recess 27 of the pump-side spring holder 25 is preferably profiled accordingly. The pump-side spring holder 25 preferably extends radially outwardly from the recess 27 and at its end is bent by about 90° toward the motor 1, as well as to the outside at the end (see FIG. 3). The dimensioning of the spring holders 24, 25 is preferably such that the spring 23 is guided laterally to the outside within the axially parallel outer sections of the spring holders 24, 25. The radial sections of this, which connect inwards, then form the pressure surfaces for the spring 23. The pump-side spring holder 25 in its axially parallel annular section 28 preferably includes three recesses 29, which are preferably each bent at one side to a support surface 30 and which on the other side are each preferably provided with a projection 31. The recesses 29 in combination with the projections 26 of the motor-side spring holder 24 form positive fit means which, in normal operation of the pump, in particular when the pump shaft 12 is driven in the working rotation direction 32, ensure that the rotational movement of the shaft 12 is transmitted onto the pump-side spring holder 25 and from there, via the support surfaces 30 of the recesses 29, onto the radial end sides of the projections 26 and thus onto the motor-side spring holder 24, which engages around the rotating axial face seal ring 19 with a positive fit and co-rotates this with the pump shaft 12. The bearing surface is preferably enlarged with respect to the projections 26 by way of the support surfaces 30, which are preferably formed by bending up a part of the ring section material 28, so that the projections 26 may not dig into the ring sections 28.

The projections 26 in combination with the recesses 29 preferably form a bayonet connection. Thus, the spring holders 24, 25, for assembly purposes, after being placed onto the pump shaft 12, are moved to one another under biasing of the spring 23, until the projections 26 engage into the recesses 29 and then rotated opposite to the rotation direction 32, so that the projections 26 engage behind the projections 31 in the manner of a bayonet, and hold the spring 23 in the biased condition. This position, which preferably only serves for the assembly, may be lifted again by way of rotating the shaft in the working rotation direction 32 (FIG. 2), as is also effected automatically on operation after the assembly has been effected, when the motor 1 starts up in the direction 32.

However, not only is the spring 23 preferably incorporated between the spring holders 24, 25, but also an abutment ring 33, which is arranged in the transition region between the cylinder shaft section 21 and the splined shaft section 22. The abutment ring 33 on its inner side is preferably profiled such that it is seated in the transition region 34 with a positive fit in the axial direction to the motor 1, as well as in the rotational direction. For this, the abutment ring 33 on its inner side comprises oblique surfaces 35, which cooperate with corresponding oblique surfaces in the transition region 34, in order to support the ring, seen in the axial direction of the pump shaft 12 toward the motor 1. The positive-fit connection in the rotation direction is effected by way of projections 36, which engage into the running-out splined shaft profile in this region. The abutment ring 33 supports the impellers 8, which are arranged on the pump shaft 12 in the splined shaft section 22 and which, in the assembled condition, are clamped with respect to the abutment ring 33 by way of an end-side nut.

The abutment ring 33 is preferably seated within the pump-side spring holder 25 and forms the inner guide for the spring 23 which surrounds this. By way of this arrangement, in combination with the motor-side spring holder 24 engaging over the stationary ring 19, the axial construction length of the centrifugal pump 2 may be considerably reduced in this region, compared to known constructional designs, by which means the assembly may be designed in a significantly more compact manner and may be designed lighter than known pumps on account of the saving in material.

The axial face seal 13 is preferably assembled from the impeller side of the pump shaft 12. After the motor shaft 11 and the pump shaft 12 have been firmly connected to one another and the connection flange 5 is attached, the axial face seal 13 is preferably assembled by way of firstly applying the stationary axial face seal ring 14 with the O-ring 15 located therein, onto the pump shaft 12 from the impeller side and fixing it in the lining of the connection flange 5. Then, the rotating axial face seal ring 19 with the O-ring 20 held therein and with the overlapping motor-side spring holder 24, is preferably assembled from the impeller-side end of the pump shaft 12, whereupon the abutment ring 33 is applied, the spring 23 added and finally the pump-side spring holder 25 applied. The pump-side spring holder 25 is preferably pressed onto the motor-side spring holder 24 under the tension of the spring 23, until the projections 26 engage into the recesses 29, whereupon the spring holders 24, 25 are rotated opposite to the rotation direction 32 and are held in this biased condition by way of the projections 31. The assembly of the impellers 8 as well as the remaining pump components is then effected. The bayonet connection, which retains the spring 23 under bias, may either be released by way of starting operation of the pump when the shaft 11, 12 rotates in the working rotation direction 32, or however, as the case may be, also manually. Then the pump-side spring holder 25 is supported by the clamped impellers 8, so that from now on, the spring force presses onto the motor-side spring holder 24 and the rotating axial face seal ring 19 which is incorporated therein, and thus presses the sliding surfaces 17, 18 onto one another as directed.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. A multi-stage centrifugal pump comprising a pump housing (3); a pump shaft (12) rotatably mounted in the pump housing, a motor-side end of the pump comprising at least one cylindrical shaft section (21) and a splined shaft section (22) connecting thereto; at least two impellers (8) arranged in a rotationally fixed manner on the splined shaft section the impellers being clamped between an abutment ring (33) seated on the pump shaft (12) and a free end of the pump shaft; and an axial face seal (13) incorporated between the cylindrical shaft section (21) and the pump housing (3), wherein the axial face seal (13) comprises a stationary axial face seal ring (14) arranged in the pump housing (3) sealed with respect to the pump housing, and a rotating axial face seal ring (19) arranged on the pump shaft (12) and sealed with respect to the pump shaft (12), said stationary axial face sealing ring and said rotating axial sealing ring (14, 19) comprising respective axial sealing surfaces (17, 18) which slide on one another and are impinged to one another by way of a spring force exerted by compression spring means (23) arranged between two spring holders (24, 25), and wherein the abutment ring (33) is arranged in a transition region (34) of the pump shaft (12) between the cylindrical shaft section (21) and the splined shaft section (22) as well as between the two spring holders (24, 25), wherein positive-fit means (26, 30) are provided between the spring holders (24, 25), which are effective at least in a working rotation direction (32) of the pump shaft (12).

2. The centrifugal pump according to claim 1, wherein the abutment ring (33) is held on the pump shaft (12) with a positive fit at least in the axial direction toward a motor-side end of the pump shaft.

3. The centrifugal pump according to claim 1, wherein the cylindrical shaft section (21) has a larger diameter than the splined shaft section (22) in a groove base, and the diameter of the cylindrical shaft section is equal or larger than the diameter of the splined shaft section (22) in the remaining region thereof.

4. The centrifugal pump according to claim 1, wherein the abutment ring (33) on an inner side thereof is designed for positive-fit engagement into a splined shaft profile of the splined shaft section (22).

5. The centrifugal pump according to claim 1, wherein the abutment ring (33) comprises oblique surfaces (35) on an inner side thereof, which are supported on at least one corresponding oblique surface of the pump shaft (12) in the transition region (34) of the pump shaft (12) between the cylindrical shaft section (21) and the splined shaft section (22).

6. The centrifugal pump according to claim 1, wherein the spring means (23) at least partly engage over the abutment ring (33) and the rotating axial face seal ring (19).

7. The centrifugal pump according to claim 1, wherein the spring means are formed by a helical compression spring (23).

8. The centrifugal pump according to claim 1, wherein the spring holders (24, 25) comprise positive-fit means (26, 31), with which they are axially fixed to one another at least in one direction under bias of the spring means (23), for the purpose of assembly.

9. The centrifugal pump according to claim 1, wherein the spring holders (24, 25) are bayoneted to one another in a manner such that locking is effected opposite to the working rotation direction (32).

10. The centrifugal pump according to claim 1, wherein a motor-side spring holder (24) of the spring holders (24, 25) on an axial face seal ring side is designed in an angulated manner such that the spring means (23) surrounds the rotating axial face seal ring (19).

11. The centrifugal pump according claim 1, wherein an impeller-side spring holder (25) of the spring holders (24, 25) comprises at least one catch which engages into a splined shaft profile of the splined shaft section with a positive fit and which connects the impeller-side spring holder (25) to the pump shaft (12) in a rotationally fixed manner.

12. The centrifugal pump according to claim 1, wherein the stationary axial face seal ring (14) comprises positive fit means (16) on an outer periphery thereof, with which the stationary axial face seal ring is secured against rotation in the pump housing (3).

13. The centrifugal pump according to claim 1, wherein an impeller-side spring holder (25) of the spring holders (24, 25) comprises recesses (29) in a peripheral wall (28) thereof which is open toward a motor-side spring holder (24) of the spring holders (24, 25) on an axial face seal ring side and into which radial projections (26) of the motor-side spring holder (24) on the axial face seal ring side engage.

14. the centrifugal pump according to claim 13, wherein edges of the recesses (29) are designed in a reinforced manner in an engagement region of the projections (26) by an enlargement of bearing surfaces (30).

* * * * *